United States Patent [19]

Marquardt

[11] 4,207,877

[45] Jun. 17, 1980

[54] BATHTUB AERATOR

[76] Inventor: Arthur F. Marquardt, 18141 Frank, Apt. 102, Roseville, Mich. 48066

[21] Appl. No.: 896,833

[22] Filed: Apr. 17, 1978

[51] Int. Cl.[2] ..... A61H 9/00

[52] U.S. Cl. ..... 128/66

[58] Field of Search ..... 128/66, 365, 369, 370

[56] References Cited

U.S. PATENT DOCUMENTS

| | | | |
|---|---|---|---|
| 3,044,469 | 7/1962 | Vigh | 128/369 |
| 3,373,740 | 3/1968 | Riepl | 128/66 |
| 3,502,072 | 3/1970 | Stillman | 128/66 |
| 3,648,690 | 3/1972 | Miller et al. | 128/66 |
| 3,683,899 | 8/1972 | LaBarber | 128/66 |
| 3,804,115 | 4/1974 | Miller et al. | 128/66 |

*Primary Examiner*—William E. Kamm

[57] ABSTRACT

A bathtub aerator formed of a pair of flexible tubes coupled together at their opposite ends to form a flexible loop for fitting within a bathtub. The coupling at one end is connected to a pressurized air source for blowing air into the tubes, so that the air may blow into the bathtub through numerous holes formed in the tubes along their lengths, to thereby agitate the water within the bathtub for massaging the bathtub occupant. The coupling at the opposite end is centrally blocked, to block off the adjacent tube ends, and is, at least initially, separable from the tube ends so that the tubes may be cut to appropriate length to fit within a particular bathtub before being interconnected with the coupling. A number of spaced apart suction cups are mounted upon the tubes to temporarily secure the tubes to the bottom wall surface of the bathtub, which cups are narrow and elongated in shape for easy manual release.

4 Claims, 9 Drawing Figures

BATHTUB AERATOR

BACKGROUND OF INVENTION

The invention herein relates to a system for blowing pressurized air into a water-filled bathtub for the purpose of agitating the water and thereby massaging the bathtub occupant. Examples of systems of this character are illustrated and described in the following U.S. Pat. Nos. 3,267,936 issued Aug. 23, 1966 to Brady; 3,373,740 issued Mar. 19, 1968 to Riepl; 3,683,899 issued Aug. 15, 1972 to LaBarber and 3,890,656 issued June 24, 1975 to Mathis.

The first three of the above identified patents illustrate and describe the use of tubes or hoses arranged in the form of a loop, temporarily positioned on the bottom of a bathtub to surround the occupant, with an appropriate means for blowing pressurized air into the loop and through holes in the tubes, into the water to agitate the water. The fourth identified patent illustrates using tubing which is permanently positioned on the exterior of the bathtub and opens through the bathtub wall into the interior thereof for blowing air into the water for the same purpose, i.e., agitating the water.

These identified systems are relatively expensive in construction and relatively difficult to install and remove from the bathtub or, such as in the case of the Riepl system, inadequate in its usefulness in various sizes and shapes of bathtubs.

Thus, in order to obtain the known benefits, such as desirable massaging of a bathtub occupant by means of aeration and agitation of the bathtub water, it is necessary to provide a system which is not only inexpensive, but extremely simple to position within and to remove from a bathtub and is adaptable, without tools or skill, to various sizes and shapes of bathtubs. The prior systems are particularly inadequate in the latter characteristic, i.e., adaptability to various sizes and shapes of bathtubs.

SUMMARY OF INVENTION

The invention herein relates to a bathtub aerator system which is formed of a pair of flexible, perforated, tubes, connected together at their opposite ends by connectors or couplings so that the loop formed of the interconnected tubes may surround the interior bottom portion of a bathtub, regardless of its size or shape for thereby surrounding the occupant thereof. The connector at one end of the loop is provided with an inlet which, in turn, is connected, through a hose, to a source of pressurized air, such as a blower or vacuum cleaner. The connector at the opposite end is preferably blocked to thereby separate the loop into two legs which provides a back pressure for better air distribution through the perforations or holes in the tubes. Suction cups mounted upon the tubes at spaced apart intervals, temporarily fasten the tubes to the interior surface of the bathtub.

Significantly, the invention herein contemplates supplying the tubes with one of the connectors or couplings separated from adjacent tube ends, so that the home owner or consumer may position the tubes within the bathtub and then cut off, with a knife or scissors, enough excess from the free ends of the tubes so that the tubes can be coupled together into a well fitted loop within that consumer's particular bathtub. Preferably, the tubing is formed of corrugated, thread-like configurations, arranged to threadedly interengage with interior threads formed on the coupling.

The coupling may be provided with left hand and right hand interior threads at its opposite ends so that it may be simultaneously threaded onto adjacent tube ends and where permanence is desired, it may be easily permanently installed by applying a small quantity of a suitable adhesive. Alternatively, it can be non-permanently installed for disassembly and cleaning when desired.

Essentially, the present invention contemplates the formation of a flexible tube formed loop which can be easily adapted by the user to the proper size for fitting within his particular bathtub and which can be easily arranged along the interior contour of the bathtub surface and easily secured thereto, then can be easily removed by a small manual force. For the purpose of securing the tube within the bathtub and to accommodate rapid and low manual force removal, the suctions cups are formed in a unique shape, namely in an approximately cigar-shape with elongated, narrow, pointed ended suction cup depressions so that a simple longitudinal and upward pull on the respective tube will disengage the suction cups from the bathtub.

As can be seen, a major objective of the invention herein is to provide a system which is inexpensive in construction, and is extraordinarily simple for the user to initially size and thereafter apply and remove from his bathtub so that it may be easily removed from the bathtub between uses of any particular person.

These and other objects and advantages of this invention will become apparent upon reading the following description, of which the attached drawings form a part.

DETAILED DESCRIPTION

Figure 1:
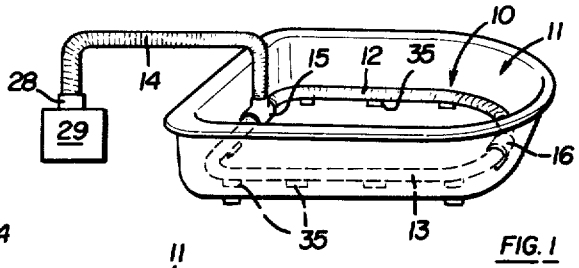
FIG. 1 is a perspective view of the bathtub aerator system installed within a typical bathtub.
Figure 2:
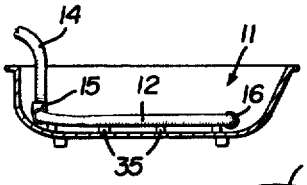
FIG. 2 is a cross-sectional view of the bathtub and aerator.
Figure 3:
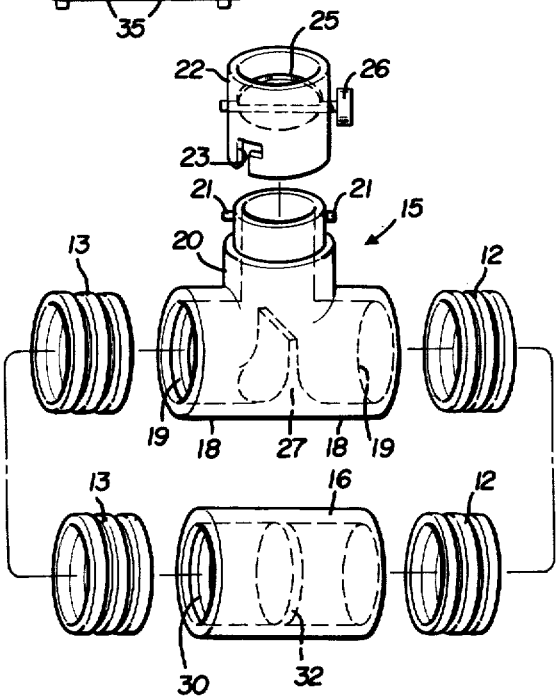
FIG. 3 is an enlarged, perspective, fragmentary view of the parts forming the aerator loop, with the parts shown disassembled.
Figure 4:
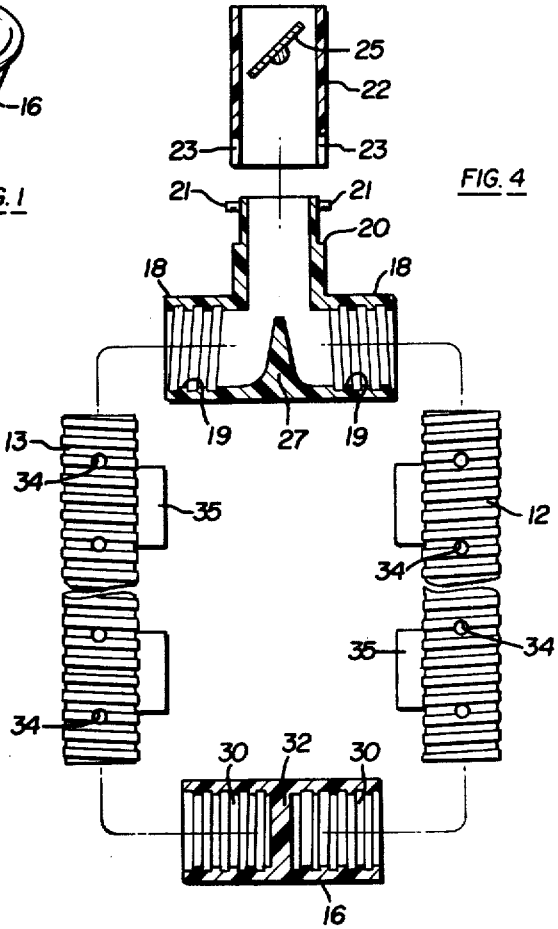
FIG. 4 is a fragmentary, disassembled, plan view of the parts forming the aerator.
Figure 5:
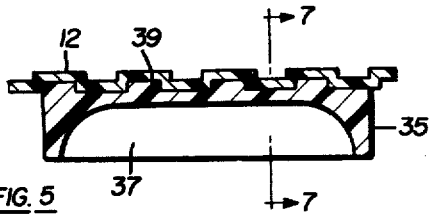
FIG. 5 is an enlarged, cross-sectional view of a fragment of a tube with the suction cup shown in cross-section.
Figure 7:
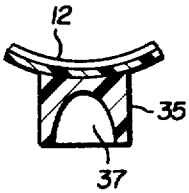
FIG. 7 is a cross-sectional view of the suction cup taken in the direction of arrows 7—7 of FIG. 5.
Figure 6:
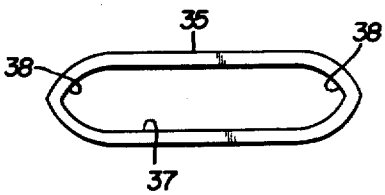
FIG. 6 is a bottom view of the suction cup illustrated in FIG. 5.

FIGS. 1 and 2 illustrate the aerator, generally designated 10, fitted within a typical bathtub 11. The aerator is formed of elongated, flexible tubes 12 and 13, which preferably are of the corrugated, thread-like configuration type.

While the size and material of which the tube is formed may vary, commercially available plastic tubing which is corrugated into a thread-like wall configuration and of an outside diameter of roughly 1½ inches has been found suitable for this purpose. Such type tubing, made, for example, of a vinyl plastic material of a commerically available and known type, is sufficiently flexible, water resistant and sturdy to satisfy the purposes of the aerator construction. An additional length of such tubing may be used to provide an air hose 14 (see FIG. 1).

The two flexible tubes 12 and 13 are coupled together at their opposite ends to form a loop. At one end the coupling is in the form of a T-connector or couple 15 and at the opposite end a tubular connector or couple 16 is used.

The T-connector is provided with opposing, aligned legs 18 which are internally threaded at 19, preferably with the threads being of opposite hands. Thus, the coupling can be simultaneously turned relative to the two tube ends and simultaneously threaded thereon and held their by the threads alone or more permanently by providing a small amount of a suitable adhesive for that purpose.

The stem 20 of the connector is provided with lugs or protrusions 21. A tubular coupling end section 22 of the air hose 14 fits over the stem, which may be reduced in diameter at its free end for that purpose, and is interconnected to that end as for example by means of a bayonet slot 23 engaging each of the lugs 21.

A conventional butterfly valve 25, having an exterior control knob 26 may be mounted within the couple end 22 of the air hose for controling the volume of air entering into the T-connector.

Preferably a divider 27 is formed, as by integral molding, within the interior of the T-connector to thereby divide the pressurized air flow from the stem into two, approximately equal, flow paths, i.e., through each of the two legs 18 and their tubes 12 and 13 respectively.

The opposite end 28 of the air hose 14 is connected to a suitable pressurized air blower 29. The blower may be either a separate unit having a small blower motor and fan which is of conventional construction or alternatively, it could be the discharge end of a conventional vacuum cleaner. A relatively low pressure is required for the purpose of the aeration, which pressure may be considerably varied. Thus, a typical vacuum cleaner will provide sufficient air pressure for the purpose herein.

The tubular connector or couple 16 is provided with an internal thread 30, which preferably is of a left and right hand configuration at its opposite ends. The middle or center of the connector is blocked with a barrier or closure 32. Thus, the connector while joining the tube ends together also prevents the flow of air from one of the tubes 12 into the other tube 13 to thereby equalize the out flow of air from the tubes through holes 34 which are formed along the lengths of each of the two tubes.

The loop formed by the tubes is designed to surround the occupant of the bathtub and for that purpose, it must be closely fitted for positioning along the juncture between the floor of the bathtub and the bathtub walls. To keep the tubes in position, suction cups 35 are mounted on the tubes at spaced apart locations along their lengths.

These suction cups 35, are formed of cigar-shaped, elongated bodies 36 made of a resilient material such as a rubber or rubber-like plastic material. The suction depressions 37 are elongated, narrowed and have tapered, pointed opposite ends 38. Preferably they are also provided with corrugated faces 39 to interfit with the corrugated or thread-like exterior configuration of the tubes. Thus, the suction cups may be adhesively secured to the tubes if molded separately or alternatively, could be integrally molded with the tubes.

Although the dimensions may vary considerably, an example of the dimensions of a suitable suction cup would be on the order of about 1½inches in length and ½ inch or less in width with the depression being slightly smaller than that. Other sizes, are also contemplated, depending upon the expense involved and the material chosen.

The suction cup, because of its unique shape, is easily applied in position in the bathtub in the usual way, that is, by pressing the cup against the bathtub wall to compress it so that upon release, the depression forms a limited vacuum. In that respect, it operates the same as conventional suction cups which typically are of a round shape, as for example, illustrated in the LaBarber U.S. Pat. No. 3,683,899 mentioned above.

However, when it comes to removing the cup, the amount of force required is considerably reduced and the removal involves simply grasping the tube and pulling it roughly longitudinally and upwardly relative to the bathtub to thus, in essence, peel the cup from the bathtub surface. Thus, removal can be effected by a person standing along side the bathtub and grasping the loop, as for example, at the tube ends near the T-connector and simply pulling the aerator upwardly and in a generally longitudinal direction which will result in an almost immediate release of the aerator from the bathtub.

Hence, it is extremely convenient to apply and to remove the aerator from the bathtub before and after each bath. In addition, the substantial flexibility of the tubing, which is not decreased by the small size and shaped suction cups spaced along the lengths of the tubing, permits the aerator to be easily stored within a relatively small container, such as a hamper having an open top and arranged within the bathroom near the bathtub. The user may grasp the aerator and fold it into the hamper or container since it will easily compact in size due to the bending of the flexible tubes. With that kind of arrangement, i.e., a hamper or container within the bathroom, the aerator device is available for each bath, as desired and thus is installed and removed so rapidly as to make it convenient to use.

When the aerator is used within the bathtub, the pressurized air from the blower passes through the stem of the T-connector, through the tubes and out through the holes in the tubes to thereby vigorously agitate the water to provide a massage to the body of the bather. The quantity of air may be controlled by manually manipulating the butterfly valve.

The control for the air inlet may vary, using other suitable controls. One suitable form of control, in place of a manual butterfly, is in the form of a changeable size hole which permits some of the air to simply blow off into atmosphere or alternatively into the bathtub near the inlet end.

Figure 9:
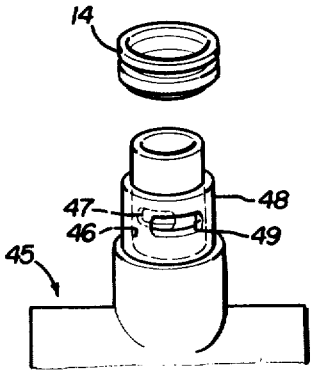
FIG. 9 is perspective fragmentary view of a modified form of T-connector air control.
Figure 8:
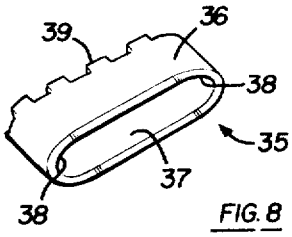
FIG. 8 is a perspective, bottom view of a suction cup.

FIG. 9 illustrates a modified form of air inlet control. Here, the modified T-connector 45 is similar to that described above, except its stem 46 is provided with an air escape slot 47. A rotatable sleeve 48 is mounted upon the stem and it too is provided with an air escape slot 49 which upon rotation of the sleeve can be arranged to either fully or partially align with the slot 47 to permit air to escape outwardly from the stem. In that way, the air pressure is controlled by bleeding off excess pressure.

As shown in FIG. 9, the air hose 14 is connected to the upper end of the stem 46 and the air hose is otherwise joined to the air blower as described above.

Having fully described an operative embodiment of this invention, I now claim:

1. A bathtub aerator for blowing pressurized air within a water filled bathtub for agitating water, comprising:

a pair of elongated, flexible tubes coupled together at their opposite ends to form a flexible tubular loop arranged upon and encircling the floor portion of a bathtub;

numerous, spaced apart holes formed in each tube along the length thereof;

a T-shaped, tubular connector having aligned tubular legs interconnected with adjacent tube ends for coupling the tubes together at one end and with a tubular stem interconnected with one end of an elongated pressurized air inlet pipe, opposite end is connected to a source of pressurized air;

and a tubular connector coupling the opposite tube ends together to form the complete loop;

said T-shaped connector having a centrally located divider wall arranged to divide the air entering through the stem into two roughly equal flow paths, each extending through a leg of the connector, whereby the pressurized air blows approximately equally out of each of the tubes into the bath water for relatively uniformly agitating the water for massaging the bathtub occupant;

said tubes being externally corrugated in a thread-like configuration for increased flexibility;

and said connector being internally threaded with opposed left and right hand threads, so that the ends of the tubes may be simultaneously threadedly engaged within connector for coupling the tube ends together;

and spaced apart suction cups mounted said tubes for temporarily fastening the tubes in place upon the bathtub bottom surface;

said suction cups being formed with suction depressions which are transversely narrow and longitudinally elongated relative to the tube axes, for facilitating manual release from the bathtub surface by pulling the tubes longitudinally and upwardly relative to the bathtub.

2. A bathtub aerator as defined in claim 1, and wherein the opposite ends of the depression are tapered to form the depression and the suction cup body surrounding it in a substantially cigar shape with roughly pointed ends, to facilitate releasing the suction cup vacuum from either end of the cup.

3. A bathtub aerator as defined in claim 1 wherein each of said suction cups includes a thread-like exterior surface which interfits with the thread-like configuration of said tubes to secure said suction cup to said tubes.

4. A bathtub aerator as defined in claim 1 wherin said T-shaped connector includes a rotatable sleeve mounted to said stem, said rotatable sleeve being provided with an air escape slot and said stem being provided with an air escape slot whereby air pressure is permitted to escape outwardly from said stem upon rotation of said sleeve to align said slot in said sleeve with said slot in said stem.

* * * * *